United States Patent [19]

Habu et al.

[11] 4,038,081

[45] July 26, 1977

[54] DEVELOPMENT METHOD

[75] Inventors: Teiji Habu; Tomio Nakajima; Eiichi Sakamoto, all of Hino, Japan

[73] Assignee: Konishiroku Photo Industry Co., Ltd., Nihonbashi-Muro, Japan

[21] Appl. No.: 661,046

[22] Filed: Feb. 24, 1976

[30] Foreign Application Priority Data

Feb. 28, 1975 Japan ..... 50-24689

[51] Int. Cl.[2] ..... G03C 5/26; G03C 5/30; G03C 1/06; G03C 1/28

[52] U.S. Cl. ..... 96/66.3; 96/95; 96/107; 96/50 R

[58] Field of Search ..... 96/107, 109, 66, 66.3, 96/66.4, 66.5, 50

[56] References Cited

U.S. PATENT DOCUMENTS

| | | | |
|---|---|---|---|
| 3,241,971 | 3/1966 | Kitze | 96/107 |
| 3,565,619 | 2/1971 | Johnson | 96/109 |
| 3,785,822 | 1/1974 | Overman | 96/107 |
| 3,895,948 | 7/1975 | Shiba et al. | 96/107 |

FOREIGN PATENT DOCUMENTS

| | | | |
|---|---|---|---|
| 664,550 | 1/1952 | United Kingdom | 96/109 |
| 667,199 | 2/1952 | United Kingdom | 96/109 |
| 677,264 | 8/1952 | United Kingdom | 96/109 |

*Primary Examiner*—Mary F. Kelley

[57] ABSTRACT

A compound having a 2- imidazoline nucleus is used a development accelerator.

9 Claims, No Drawings

DEVELOPMENT METHOD

This invention relates to a method for developing a light-sensitive silver halide photographic material in the presence of a development accelerator.

As one of methods for increasing the sensitivities of light-sensitive silver halide photographic materials, there is a method according to so-called first ripening (physical ripening) in which conditions at the time of the preparation of silver halide crystals are properly selected. According to this method, however, it is necessary for the sensitization to make the silver halide crystals greater, with the result that finished images tend to be deteriorated in sharpness. Thus, the said method cannot be said to be a preferable method. There is another method in which sensitizers are added either before, during or after the second ripening (chemical ripening) of emulsions. Typical examples of such sensitizers are noble metal salts, particularly gold salts, and sulfur-containing compounds, particularly thiosulfates, and there have been made such attempts that the said sensitizers, or the combinations thereof, are added right before the chemical ripening of emulsions. Further, as to sensitization methods using the so-called development accelerators in which quaternary ammonium salts, thioethers or polyalkylene oxide derivatives are added during or after the chemical ripening of emulsions, there have been proposed various methods. However, such sensitization techniques at the time of second ripening have limits in sensitization effects. That is, if a photographic material is intended to be increased in, for example, sensitivity to a desired degree, fog is increased and graininess is lowered. At the same time, the photographic material is degraded in storability and is liable to be greatly deteriorated in photographic properties. Accordingly, the said additives should be used in minimum required amount to cause such disadvantage that a desired sensitivity cannot always be obtained.

A first object of the present invention is to provide a development method which accelerates the development speed of a light-sensitive silver halide photographic material and which makes it possible to obtain a desired effective sensitivity without forming fog and without degrading graininess, and to provide a development accelerator which allows to display the said effects.

A second object of the invention is to provide a development accelerator which, at the time of lith-type development of a lithographic material, enhances the developability and makes the development latitude greater without degrading dot quality.

As the result of extensive studies, we have found that the above-mentioned objects can be accomplished by developing a light-sensitive silver halide photographic material in the presence of, as a development accelerator, a compound having a 2-imidazoline nucleus therein as a main nucleus. The compound is, however, preferably one represented by the following formulas:

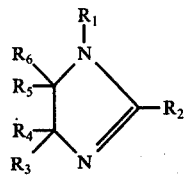

(I)

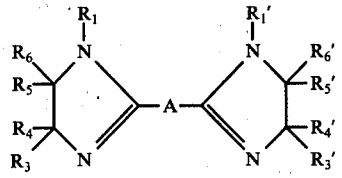

(II)

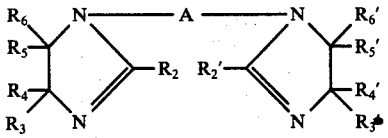

(III)

wherein $R_1$ and $R_1'$ are individually hydrogen, halogen, hydroxyl, or a substituted or unsubstituted alkyl, aralkyl, alkenyl, amino, aryl or acryl group; $R_2$ and $R_2'$ are individually hydrogen, hydroxyl, or a substituted or unsubstituted alkyl, aralkyl, alkenyl, amino, aryl, hydrazino, heterocyclic, alkylthio or aralkylthio group; $R_3$, $R_3'$ $R_4$, $R_4'$, $R_5$, $R_5'$, $R_6$ and $R_6'$ are individually hydrogen, alkyl, aryl or a heterocyclic group; and A is a divalent atomic group.

The reason why the said compounds have the effects of accomplishing such objects of the present invention as mentioned previously is considered ascribable to the presence of said nuclei. In practice, the effects of the compounds do not substantially change depending on the kinds of substituents introduced into said nuclei or the kinds of connecting groups of said nuclei in the case of bis-type compounds, and the compounds having optional substituents or connecting groups are effectively used in the present invention. However, the compounds of the formulas are especially advantageous in the effect thereof. $R_1$ to $R_6$, $R_1'$ to $R_6'$ and A in the aforesaid general formulas can be selected from an extremely wide scope of substituents. As A in the formulas, for example, any substituent is effective so far as it is a divalent atomic group, and typical examples thereof are alkylene, arylene, alkylenediimino and alkylenedithio.

Typical examples of the compounds of the aforesaid general formulas which are used in the present invention are shown below.

(Exemplified Compounds)

a. Compounds of the type represented by general formula (I):

(The structural formula of each compound is represented by showing only $R_1$ to $R_6$, omitting the 2-imidazoline nucleus.)

| Exemplified compound No. | $R_1$ | $R_2$ | $R_3$ | $R_4$ | $R_5$ | $R_6$ |
|---|---|---|---|---|---|---|
| 1 | H | H | H | H | H | H |
| 2 | H | $-CH_3$ | H | H | H | H |
| 3 | H | 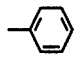 | H | H | H | H |

-continued

| Exemplified compound No. | $R_1$ | $R_2$ | $R_3$ | $R_4$ | $R_5$ | $R_6$ |
|---|---|---|---|---|---|---|
| 4 | H | $-CH_2-$ 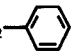 | H | H | H | H |
| 5 | 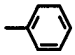 | 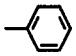 | H | H | H | H |
| 6 | 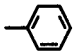 | $-CH_3$ | H | H | H | H |
| 7 | H | H | H | H | H | H |
| 8 | H | $-CH_2OH$ | H | H | H | H |
| 9 | H | $-C_2H_5$ | H | H | H | H |
| 10 | H | $-C_3H_7$(i) | H | H | H | H |
| 11 | H | H | H | $-CH_3$ | H | H |
| 12 | $-CH=CH_2$ | H | H | H | H | H |
| 13 | $-CH_2-$ 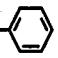 | H | H | H | H | H |
| 14 | H | H | $-CH_3$ | $-CH_3$ | H | H |
| 15 | H | $-CH_3$ | $-CH_3$ | H | $-CH_3$ | H |
| 16 | $-CH_3$ | $-CH_2OH$ | H | H | H | $-CH_3$ |
| 17 | H | $-NH_2$ | H | H | H | H |
| 18 | $-CH_3$ | $-NH_2$ | H | H | H | H |
| 19 | $-NH_2$ | 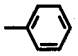 | H | H | $-CH_3$ | H |
| 20 | H | $-NH-$ 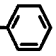 | H | H | H | H |
| 21 | H | $-N(CH_3)_2$ | H | H | H | H |
| 22 | H | $-NHCH_2-$ 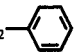 | H | H | H | H |
| 23 | H | $-NHNH_2$ | H | H | H | H |
| 24 | H | $-NHNH-$ 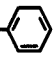 | H | H | H | H |
| 25 | H | $-CH_2-$ 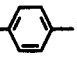 $-NH_2$ | H | H | H | H |
| 26 | H | $-SC_2H_5$ | H | H | H | H |
| 27 | H | $-SCH_2CH_2NH_2$ | H | H | H | H |
| 28 | H | $-SCH_2CH_2NH_2$ | $-CH_3$ | 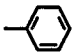 | H | H |
| 29 | H | $-SCH_2-$ 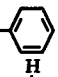 | H | H | H | H |
| 30 | $-CH_3$ | H 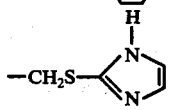 | H | H | H | H |
| 31 | H | $CH_3$ 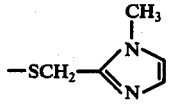 | H | H | H | H |
| 32 | $-CH_3$ | 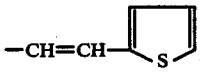 | H | H | H | H |
| 33 | $-COCH_2COCH_3$ | $-SCH_3$ | H | H | H | H |
| 34 | $-CH_2CH_2NH_2$ | H | H | H | H | H |
| 35 | $-CO-$ 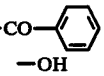 | H | H | H | H | H |
| 36 | $-OH$ | 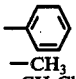 | $-CH_3$ | $-CH_3$ | $-CH_3$ | $-CH_3$ |
| 37 | Br | $-CH_3$ | H | H | H | H |
| 38 | H | $-CH_2Cl$ | H | H | H | H |
| 39 | H | $-CH=CH_2$ | H | H | $-CH_3$ | H |
| 40 | H | $-C_5H_9$(i) | H | H | H | H |
| 41 | H | $H_2N$ 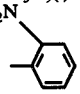 | H | H | H | H |
| 42 | H | $-OH$ | H | H | H | H |
| 43 | H | 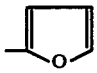 | 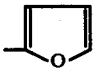 | H | 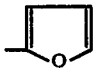 | H |

b. Compounds represented by general formulas (II) and (III):

| Exemplified compound No. | |
|---|---|
| 44) | 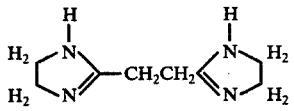 |
| 45) | 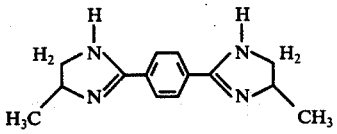 |
| 46) | 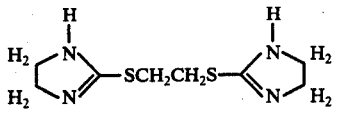 |
| 47) | 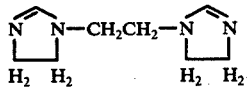 |
| 48) | 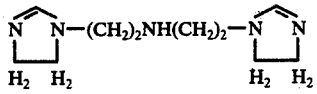 |
| 49) | 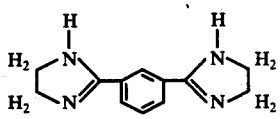 |
| 50) | 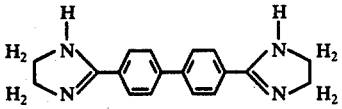 |
| 51) | 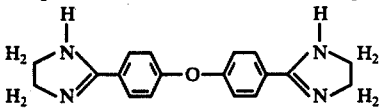 |
| 52) | 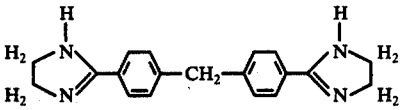 |
| 53) | 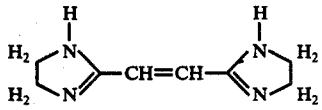 |
| 54) | 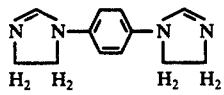 |
| 55) | 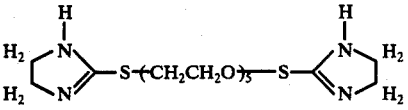 |

These compounds can easily be synthesized according to any method disclosed in, for example, the below-mentioned literatures, by using 1,2-diamines or derivatives thereof as starting materials.

Journal of the Chemical Society, Vol. 1927, page 2621; the same Journal, Vol. 1947, page 497; Berichte, Vol. 74, page 1763 (1941); Helvetica Chimica Acta, Vol. 27, page 1762 (1944); Journal of the American Chemical Society, Vol. 57, page 2424 (1935); the same Journal, Vol. 61, pages 822 and 3195 (1937); the same Journal, Vol. 69, page 1688 (1947); and the same Journal, Vol. 70, page 1629 (1948).

In the present invention, the compound of each of the aforesaid general formulas is required present at the time of development of a light-sensitive silver halide photographic material. For this purpose, there may be adopted, for example, any procedure such that the compound is previously incorporated into the light-sensitive silver halide photographic material, the compound is incorporated into a developing solution, or the compound is incorporated into a so-called pre-processor used before the development. In case the compound is desired to be previously incorporated into the silver halide photographic material, the effect is remarkable when it is incorporated into a silver halide emulsion layer. However, favorable results can also be obtained even when incorporated into a layer or layers adjacent thereto.

Light-sensitive silver halide photographic materials to which the present invention is applicable include those of various types. That is, the present invention is applicable to, for example, conventional black-white photographic materials, X-ray photographic materials, color photographic materials, diffusion transfer method photographic materials, special photographic materials, etc. However, the advantageous of the invention is noticeable for photographic materials used for obtaining fine-grain developed silver or for lith-type photographic materials.

In the above-mentioned silver halide photographic materials, various silver halides such as silver bromide, silver chloride, silver chlorobromide, silver iodobromide and silver iodochlorobromide are used. Further, silver halide emulsions containing said silver halides may be subjected to ordinary chemical sensitization, may contain various sensitizers, and may be incorporated with development accelerators other than those according to the present invention. In these cases, more enhanced sensitivity increase and more development acceleration can be obtained. Further, the said silver halide emulsions may be spectrally sensitized by use of cyanine dyes, cyanine dye complexes or merocyanine dyes.

Further, the silver halide photographic emulsions may contain various couplers such as colorless couplers, colored couplers, development inhibitor-releasing type couplers and competing couplers, and compounds of the types releasing colorless compounds and development inhibitors by reaction with the oxidation products of color developing agents, and may further be incorporated with various ordinary photographic additives, e.g. azaindenes as stabilizers; mucohalogenoacids, aldehydes, dialdehyde compounds, or ethyleneimine type, vinylsulfone type, methanesulfonic acid type or acryloyl type compounds as hardeners; saponin or sulfosuccinic acids as coating aids; wetting agents; plasticizers; film property improvers; antioxidants; latent image fading inhibitors; fluorescent brighteners; toners; antistain agents; etc.

The developing solution used in the present invention may be an developing solution employed in the development of ordinary silver halide photographic materials. Examples of developing agents to be used include hydroquinones, Metols, 1-phenyl-3-pyrazolidones and p-phenylenediamines. Further, the developing solution may, if necessary, be incorporated with an antioxidant, a preservative, a development inhibitor, a pH controller, a buffer, an antifoggant, a hardener, a precipitation preventer or the like.

When the present invention is applied to lith-type development, there is used, in general, the so-called lith-type developing solution containing a developing agent composed of hydroquinone in combination with a sodium aldehyde bi-sulfite adduct or acetone-sodium hydrogen-sulfite adduct. To this developing solution, a small amount of an alkali sulfite may be added in order to enhance the storability thereof. Further, a pH buffer such as a water-soluble acid, alkali or salt, a halogenated alkali, or an antifoggant such as a benzotriazole or a 1-phenyl-5-mercaptotetrazole may be added.

Furthermore, in order to prevent the developing solution from oxidation, there may be used such 3,6-dihydroxypyridazines as described in Japanese Patent Laying Open-to-Public No. 76601/73 or such polyamines as described in Japanese Patent Laying Open-to-Public No. 41803/73. In addition, polyalkylene oxides for improving the dot quality, various amine type compounds, alkylene glycols, organic solvents such as methyl alcohol, dimethylformamide, cellosolve, etc. or ascorbic acids may also be used.

When the compound represented by each of the aforesaid general formulas is added to a lith-type developing solution which has, if necessary, been incorporated with such various additives as above, not only the developability can be greatly enhanced but also a good quality dot image can be obtained. The effect is particularly marked when 2-methylimidazoline is used.

In incorporating into a developing solution, for example, the compound of the aforesaid general formulas is used in an amount of 0.01 to 100 g., preferably about 0.05 to 20 g. per liter of the solution. In incorporating into a silver halide emulsion, for example, the compound is preferably used in an amount of 0.01 to 100 g. per mole of silver halide. In incorporating into a layer contiguous to the silver halide emulsion layer also, the compound may be used in such an amount per unit area as to become identical with substantially the same amount as in the silver halide emulsion. In incorporating into a developing solution, the compound may be added before preparation or at the time of preparation of the developing solution. In this case, the compound may be added either directly or after dissolving in water or the like. In incorporating into a silver halide emulsion, the compound may be added at an optional stage during preparation of the emulsion. Preferably, however, the compound is added after completion of the second ripening and before coating of the emulsion. In this case, the most desirable results can be obtained.

When the present invention is applied to the development of light-sensitive silver halide photographic materials, development acceleration can be attained without any increase in fog. Particularly when the compounds according to the present invention are incorporated into lith-type developing solutions for lith-type films, the development latitude for dot quality becomes high, and the development speed becomes uniform consistently from the initial stage development to the later stage development, with the result that good quality, sharp dot images can always be obtained over wide ranges of development time and development temperature.

Another advantage derived from the use of the compounds according to the present invention is that a marked development-accelerating action can be exhibited, preventing the desensitization at the initial stage development which is caused in processing lith-type photographic materials containing polyalkylene oxide type compounds in light-sensitive silver halide photographic materials.

When the compounds according to the present invention are used, therefore, development can be effected without elevating the development temperature in order to accelerate the development speed, and, in some cases, rapid processing can also be effected by elevating the development temperature.

Such excellent effects as mentioned above cannot be obtained unless the compounds according to the present invention are used. Other nitrogen-containing heterocyclic compounds similar in structure to the compounds according to the present invention, e.g. imidazoles, have such disadvantages that they are inferior in solubility, are so considerable in formation of fog, in general, as not to increase the effective speed, and invite the degradation of dot quality when used in lith-type developing solutions. Thus, the compounds of prior art are far inferior in characteristic properties than the compounds according to the present invention.

The present invention is illustrated in more detail below with reference to examples, but the modes of practice of the invention are not limited to the examples.

EXAMPLE 1

A positive film prepared by coating a microfine silver chlorobromide emulsion on a cellulose triacetate film base was exposed through optical wedges by use of a sensitometer (Model KS-1, manufactured by Konishiroku Photo Industry Co., Ltd.). Subsequently, the film (sample) was developed at 20° C. for 4 minutes with a developing solution (1) of the fomulation shown below. The developing solution had been incorporated or not incorporated with such compounds according to the present invention as shown in Table 1, or with 2-methylimidazole as a control compound.

| Developing solution (1): | |
|---|---|
| Water | 750 ml. |
| Metol | 1 g. |
| Anhydrous sodium sulfite | 75 g. |
| Hydroquinone | 9 g. |
| Sodium carbonate (monohydrate) | 27 g. |
| Potassium bromide | 5 g. |
| Water to make | 1 liter. |

The developed sample was subjected to sensitometry to obtain such results as shown in Table 1. In Table 1, the speed is a relative speed measured when the speed of the sample developed with a blank developing solution containing neither of the compound according to the present invention nor the control compound was assumed as 100.

Table 1

| Additive | Amount added (g/l Developing Solution) | Speed | Fog | Gamma |
|---|---|---|---|---|
| None | — | 100 | 0.04 | 1.20 |
| Exemplified compound (1) | 1 | 175 | 0.04 | 1.25 |
| | 5 | 205 | 0.05 | 1.43 |

Table 1-continued

| Additive | Amount added (g/l Developing Solution) | Speed | Fog | Gamma |
|---|---|---|---|---|
| Exemplified compound (3) | 1 | 130 | 0.04 | 1.25 |
| | 5 | 160 | 0.05 | 1.30 |
| Exemplified compound (7) | 0.5 | 120 | 0.04 | 1.20 |
| | 3.0 | 130 | 0.04 | 1.27 |
| Exemplified compound (16) | 2 | 115 | 0.04 | 1.30 |
| | 6 | 140 | 0.04 | 1.35 |
| 2-Methylimidazole (Control compound) | 1 | 110 | 0.10 | 1.20 |
| | 5 | 120 | 0.14 | 1.25 |

As is clear from Table 1, it is understood that in the case of a developing solution containing the above-mentioned compound according to the present invention, the resulting image is excellent in speed and gamma and less in fog, whereas in the case of a developing solution containing the control compound, the resulting image is considerably fogged and is less in sensitivity.

EXAMPLE 2

A high speed silver iodobromide emulsion containing 5 mole% of silver iodide was coated on a cellulose triacetate film base to prepare a sample, which was then exposed in the same manner as in Example 1. Subsequently, the sample was developed at 20° C. for 7 minutes with a developing solution (2) shown below. The developing solution had been either incorporated or not with the compound of the present invention as shown in Table 2. Developing solution (2):

| Developing solution (2): | |
|---|---|
| Water | 750 ml. |
| 1-Phenyl-3-pyrazolidone | 0.2 g. |
| Anhydrous sodium sulfite | 100 g. |
| Hydroquinone | 5 g. |
| Boric acid | 0.2 g. |
| Borax | 3.5 g. |
| Potassium bromide | 1 g. |
| Water to make | 1- liter |

The developed sample was subjected to sensitometry tests to obtain such results as shown in Table 2. In Table 2, the speed is a relative speed measured when the speed of the sample developed with a blank developing solution containing no compound according to the present invention was assumed as 100.

Table 2

| Additive | Amount added (g/l Developing Solution) | Speed | Fog | Gamma |
|---|---|---|---|---|
| None | — | 100 | 0.05 | 0.80 |
| Exemplified compound (1) | 5 | 110 | 0.05 | 0.82 |
| | 10 | 120 | 0.06 | 0.87 |
| Exemplified compound (6) | 5 | 105 | 0.05 | 0.80 |
| | 10 | 110 | 0.05 | 0.85 |

Table 2-continued

| Additive | Amount added (g/l Developing Solution) | Speed | Fog | Gamma |
|---|---|---|---|---|
| Exemplified compound (10) | 5 | 107 | 0.06 | 0.83 |
| | 10 | 115 | 0.06 | 0.84 |

As is clear from Table 2, it is understood that even in the case of the sample coated with a high speed emulsion, the resulting image can be made less in fog with high speed when processed with a developing solution containing each of the above-mentioned compounds according to the present invention.

EXAMPLE 3

A high resolution photographic plate prepared by coating on a glass plate an emulsion comprising silver iodobromide particles having an average particle size of 0.05 μ was exposed. Thereafter, the plate was developed at 20° C. for 5 minutes with a D-19 developing solution (prepared according to the formulation of Eastman Kodak Co.) which had been incorporated or not incorporated with the compound according to the present invention as shown in Table 3. The developed sample was subjected to sensitometry tests to obtain such results as shown in Table 3. In Table 3, the speed is a relative speed measured when the speed of the sample developed with a blank developing solution was assumed as 100, containing no compound according to the present invention, and the relative development time is a development time necessary to obtain a speed of 100.

Table 3

| Additive | Amount added (g/l Developing Solution) | Speed | Fog | Gamma | Relative development time |
|---|---|---|---|---|---|
| None | — | 100 | 0.04 | 7.0 | 5 min. |
| Exemplified compound (7) | 5 | 150 | 0.04 | 8.5 | 4 min. |
| Exemplified compound (8) | 5 | 190 | 0.04 | 9.1 | 3 min. 15 sec. |
| Exemplified compound (15) | 5 | 180 | 0.04 | 8.7 | 3 min. 30 sec. |

EXAMPLE 4

A lith-type film prepared by coating a spectrally sensitized silver iodobromide emulsion on a polyethylene terephthalate film base was exposed to light through optical wedges and a magenta contact screen by means of a sensitometer (Model KS-IV, manufactured by Konishiroku Photo Industry Co., Ltd.).

Then, a lith-type developed solution (Developing solution (3)) of the below-indicated composition was prepared and equally divided into seven portions, one of which was used as it is as the control, while the other six were individually added with the below-indicated compound of the present invention as seen in Table 4. By using each of the seven developing solutions thus obtained, development for the above exposed lith-type films was effected at 27° C. for the varying periods of time, i.e. 1 minute and 20 seconds, 1 minute and 40 seconds, and 2 minutes. The influence of the development time on speed, contrast and dot quality was tested.

| Developing solution (3) | |
|---|---|
| Water | 750 ml. |
| Hydroquinone | 16 g. |
| Sodium aldehyde bi-sulfite adduct | 50 g. |

-continued

| | |
|---|---|
| Anhydrous sodium sulfite | 2 g. |
| Boric acid | 2 g. |
| Potassium bromide | 1 g. |
| Sodium carbonate (monohydrate) | 60 g. |
| Triethylene glycol | 40 g. |
| 3,6-Dihydroxypyridazine | 5 g. |
| Water to make 1000 ml. | |

The results obtained are shown in Table 4. In the table, the speed is a relative speed measured when the speed obtained by using the control developing solution free from any compound of the present invention was assumed as 100. The contrast was determined in terms of an average slope of the characteristic curve between the density of 0.1 and that of 2.0. The dot quality was evaluated by microscopic observation of the dot image obtained corresponding to the exposed portion through the magenta contact screen. The results of the evaluation is expressed in 5 grades, in which the grade "5" means the fringe-free sharpest dots whereas the grade "1" means the dots with considerable fringes.

Table 4

| Additive | Amount added (g/l Develop. Soln.) | Speed | | | Contrast | | | Dot quality | | |
|---|---|---|---|---|---|---|---|---|---|---|
| | | 1'20" | 1'40" | 2' | 1'20" | 1'40" | 2' | 1'20" | 1'40" | 2' |
| None | — | 21 | 45 | 100 | 3.0 | 4.7 | 6.5 | 2 | 2 | 3 |
| Exemplified compound (1) | 2 | 45 | 100 | 180 | 5.4 | 6.4 | 6.9 | 4 | 5 | 4 |
| Exemplified compound (2) | 2 | 30 | 70 | 120 | 5.0 | 6.2 | 6.7 | 4 | 5 | 5 |
| Exemplified Compound (12) | 2 | 35 | 73 | 130 | 4.7 | 6.0 | 6.6 | 4 | 5 | 5 |
| Exemplified compound (13) | 2 | 34 | 75 | 125 | 4.6 | 6.0 | 6.6 | 4 | 5 | 5 |
| Exemplified compound (14) | 2 | 35 | 85 | 150 | 5.2 | 6.2 | 6.6 | 4 | 5 | 4 |
| Exemplified compound (18) | 2 | 40 | 90 | 160 | 5.1 | 6.1 | 6.8 | 4 | 5 | 4 |

As is apparent from Table 4, the lith-type developing solutions containing the compounds of the present invention can yield, over the broad range of development time, good images excellent in speed, contrast and dot quality.

EXAMPLE 5

The compound as indicated in Table 5 was added in the form of an aqueous or methanol solution to a silver iodobromide emulsion for photographic negative, containing 3 mole% of silver iodide, at the time of completion of second repening of said emulsion. The thus prepared emulsion was coated onto a cellulose triacetate film base.

The light-sensitive sample obtained was exposed to light in the same manner as in Example 1, developed with the developing solution (2) of Example 2 at 20° C. for 7 minutes, and then subjected to sensitometry tests. The results are shown in Table 5. In this table, the speed is a relative speed measured when the speed of the sample not containing any compound of the present invention was assumed as 100.

Table 5

| Additive | Amount added (g/mole AgX) | Speed | Fog | Gamma |
|---|---|---|---|---|
| None | — | 100 | 0.05 | 0.75 |
| Exemplified compound (22) | 3 | 110 | 0.05 | 0.79 |
| | 5 | 140 | 0.06 | 0.83 |
| Exemplified compound (41) | 3 | 105 | 0.05 | 0.77 |
| | 5 | 130 | 0.05 | 0.80 |

As is apparent from Table 5, the silver halide emulsion added with the compound of the invention can show good sensitivity without any increased fogging.

EXAMPLE 6

On a cellulose triacetate film base, 1. a red-sensitive silver halide photographic emulsion containing a cyan coupler capable of forming a cyan image through the reaction with the oxidation product of a color developing agent,
2. a gelatin for an inter layer,
3. a gree-sensitive silver halide photographic emulsion containing a magenta coupler capable of forming a magenta image through the oxidation product of a developing agent,
4. a yellow filter layer, and
5. a blue-sensitive silver halide photographic emulsion containing a yellow coupler capable of forming a yellow image through the reaction with the oxidation product of a developing agent.

were coated in this order thereby to obtain a multilayered color reversal film.

Then, this film was exposed to light as in Example 1 and developed at 20° C. for 10 minutes with a first developing solution (Developing solution (4)) added with the compound of the present invention as indicated in Table 6, said first developing solution having the following composition.

| | |
|---|---|
| Developing solution (4): | |
| Water | 750 ml. |
| Metol | 2 g. |
| Anhydrous sodium sulfite | 60 g. |
| Hydroquinone | 5 g. |
| Sodium carbonate (monohydrate) | 50 g. |
| Potassium bromide | 8 g. |
| Potassium thiocyanate | 1.5 g. |
| Water to make total 1000 ml. | |

After carrying out hardening and stop followed by water-washing, the film was subjected to second light-exposure from both sides of said film. Then, the film was treated by color development at 20° C. for 12 minutes with a color developing solution (Developing solution (5)) having the following composition.

| | |
|---|---|
| Developing solution (5): | |
| Water | 750 ml. |
| N,N-Diethyl-p-phenylenediamine sulfate | 5 g. |
| Sodium carbonate (monohydrate) | 82 g. |
| Anhydrous sodium sulfite | 2 g. |
| Potassium bromide | 1 g. |
| Water to make total 1000 ml. | |

Then, the film was treated by stopping, fixing, water-washing and bleaching, followed by rinsing for 20 minutes and drying.

The film samples obtained in that way were subjected to sensitometry tests. The results together with the relative development times are shown in Table 6. The speed in this table is a relative speed measured when the speed of each sample developed with unmodified developing solution (4) was assumed as 100. The relative development time means a development time required to obtain a speed value of 100.

Table 6

| Additive | Amount added (g/l Develop. Soln.(4) | Speed | Relative development time |
|---|---|---|---|
| None | — | 100 | 10 min. |
| Exemplified compound (20) | 5 | 120 | 8 min. 45 sec. |
| | 10 | 145 | 7 min. |
| Exemplified compound (36) | 5 | 110 | 9 min. 20 sec. |
| | 10 | 130 | 8 min. |
| Exemplified compound (37) | 5 | 115 | 9 min. |
| | 10 | 135 | 7 min. 30 sec. |

As is apparent from Table 6, the compounds of the present invention show good acceleration for development of multi-layered color photographic light-sensitive materials.

What we claim is:

1. A development method for an image-wise exposed light-sensitive silver halide photographic material which comprises developing, by a developing agent, the photographic material in the presence of a compound represented by the following formulas:

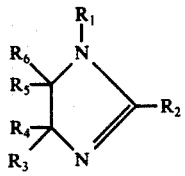

(I)

-continued

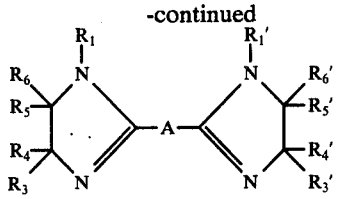

(II)

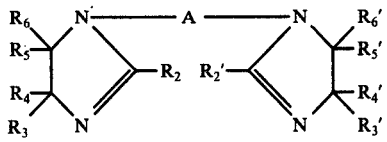

(III)

wherein $R_1$ and $R_1'$ are individually hydrogen, halogen, hydroxyl, or a substituted or unsubstituted alkyl, aralkyl, alkenyl, amino, aryl or acryl group; $R_2$ and $R_2'$ are individually hydrogen, hydroxyl, or a substituted or unsubstituted alkyl, aralkyl, alkenyl, aryl, hydrazino, heterocyclic, alkylthio or aralkylthio group; $R_3$, $R_3'$, $R_4$, $R_4'$, $R_5$, $R_5'$, $R_6$ and $R_6'$ are individually hydrogen, alkyl, aryl or a heterocyclic group; and A is a divalent atomic group said compound being present in the material or in a developer bath of the developer composition.

2. A development method according to claim 1 wherein the photographic material comprises the compound.

3. A development method according to claim 2 wherein the divalent atomic group in the formulas is selected from the group consisting of alkylene, arylene, alkylene diimino and alkylenedithio.

4. A development method according to claim 2 wherein the compound is in an amount of 0.01 to 100 g. inclusive per mole of the silver halide.

5. A development method according to claim 2 wherein the photographic material is of lith.

6. A development method according to claim 1 wherein the developing solution comprises the compound.

7. A development method according to claim 6 wherein the compound is in an amount of 0.01 to 100 g. inclusive per liter of the solution.

8. A development method according to claim 7 wherein the amount of the compound is 0.05 to 20 g. per liter of the solution.

9. A development method according to claim 6 wherein the divalent atomic group is selected from the group consisting of alkylene, arylene, alkylene diimino and alkylene dithio.

* * * * *